US007690732B2

(12) United States Patent
Olarte

(10) Patent No.: US 7,690,732 B2
(45) Date of Patent: Apr. 6, 2010

(54) MOLDED SEAT ASSEMBLY WITH FLEXIBLE WEAVING

(75) Inventor: Alvaro Mauricio Olarte, Aventura, FL (US)

(73) Assignee: Series International, LLC, Miami, FL (US)

( * ) Notice: Subject to any disclaimer, the term of this patent is extended or adjusted under 35 U.S.C. 154(b) by 0 days.

(21) Appl. No.: 11/677,805

(22) Filed: Feb. 22, 2007

(65) Prior Publication Data

US 2008/0203790 A1 Aug. 28, 2008

(51) Int. Cl.
*A47C 7/02* (2006.01)

(52) U.S. Cl. ..... 297/452.53; 297/452.22; 297/452.48; 297/452.6; 297/335; 297/248

(58) Field of Classification Search ..... 297/452.22, 297/452.48, 452.53, 452.54, 452.57, 452.6, 297/452.64, 335, 248
See application file for complete search history.

(56) References Cited

U.S. PATENT DOCUMENTS

| | | | | | |
|---|---|---|---|---|---|
| 2,942,652 | A * | 6/1960 | Chapman | 297/452.22 |
| 3,170,731 | A * | 2/1965 | Caldemeyer et al. | 297/452.35 |
| 3,264,034 | A | 8/1966 | Lawson | 297/456 |
| 3,310,300 | A | 3/1967 | Lawson | 267/111 |
| 3,531,552 | A * | 9/1970 | Getz et al. | 264/46.7 |
| 3,880,467 | A * | 4/1975 | Tischler | 297/452.53 |
| 4,077,669 | A * | 3/1978 | Fox | 297/452.48 |
| 4,542,887 | A * | 9/1985 | Bethell et al. | 264/46.4 |
| 4,603,907 | A | 8/1986 | Witzke | 297/452 |
| 4,702,522 | A | 10/1987 | Vail et al. | 297/452 |
| 5,142,757 | A * | 9/1992 | Thary | 297/452.58 |
| 5,236,247 | A | 8/1993 | Hewko | 297/452.1 |
| 5,316,375 | A * | 5/1994 | Breen | 297/452.34 |
| 5,788,332 | A * | 8/1998 | Hettinga | 297/452.55 |
| 5,971,466 | A * | 10/1999 | Hashimoto | 296/65.02 |
| 5,988,757 | A | 11/1999 | Vishey et al. | 297/452.31 |
| 6,056,278 | A * | 5/2000 | Bullard et al. | 267/91 |
| 6,425,153 | B1 * | 7/2002 | Reswick | 5/655.9 |
| 6,565,157 | B2 * | 5/2003 | Barile et al. | 297/452.52 |
| 6,698,834 | B2 * | 3/2004 | Olarte | 297/335 |
| 6,786,549 | B1 * | 9/2004 | Olarte | 297/335 |
| 6,857,699 | B2 * | 2/2005 | Ashton et al. | 297/220 |
| 2001/0023510 | A1 * | 9/2001 | Masubuchi | 5/636 |
| 2007/0170759 | A1 * | 7/2007 | Nolan et al. | 297/250.1 |

FOREIGN PATENT DOCUMENTS

JP 06198087 A * 7/1994

* cited by examiner

*Primary Examiner*—Laurie K Cranmer
(74) *Attorney, Agent, or Firm*—St. Onge Steward Johnston & Reens LLC

(57) ABSTRACT

A seat assembly including an assembly frame having at least two seat connection brackets, a seat frame, two or more connectors attached to the seat frame, the two or more connectors removably attached to the two or more seat connection brackets, two or more flexible supports extending across at least a portion of the seat frame, each support including a woven material, and a foam cushion including one or more holes, wherein the seat frame and the two or more flexible supports are molded within the foam cushion, and wherein the one or more connectors extend at least partially within the one or more holes.

21 Claims, 6 Drawing Sheets

MOLDED SEAT ASSEMBLY WITH FLEXIBLE WEAVING

FIELD OF THE INVENTION

The invention relates to seat assemblies, such as those typically found in auditoriums, theaters or the like, and more specifically to a seat assembly comprising flexible weaving within molded foam.

BACKGROUND OF THE INVENTION

Auditorium seating typically includes a seat and a back mounted to a frame assembly, with the back being fixed and the seat being pivotable throughout a range of movement. The seating surfaces generally include a rigid frame, a padding layer over at least a portion of the frame, and a seat cover. Some of such seating surfaces also include metal springs or wire mesh connected to the frame beneath or within the padding. See, for example, U.S. Pat. Nos. 3,310,034 and 3,264,034 to Lawson.

A disadvantage of prior art seating assemblies is that they generally require welding and/or other fastening means to attach the springs or wire mesh. Springs are also relatively costly due to the materials required and the tooling to manufacture the springs and wire mesh. Further, springs and wire mesh can often be felt while sitting on the seat, particularly after the padding begins to wear from its contact with the springs or mesh. Springs, in particular, are often noisy as well. A further disadvantage is that metal springs and mesh are prone to rush and corrosion.

Some seats, particularly in the automobile industry, have incorporated load bearing webs or sheets in place of springs and wire mesh. For example, U.S. Pat. No. 4,603,907 to Witzke discloses a vehicle seat assembly including a frame having side rails and a load carrying pre-stretched web mounted on and extending between the side rails. Likewise, U.S. Pat. No. 4,702,522 to Vail et al. discloses a vehicle seating assembly including a frame and a fibrous matrix encapsulated in a foam body. Witzke and Vail, however, both disclose a seat in which a single continuous web is connected between two side rails. Furthermore, the web requires complicated mounting means such as the J-clip mounting members and flanges taught by Witzke.

What is desired, therefore, is an improved seat assembly to overcome the disadvantages in the prior art. What is also desired is an improved seat assembly for auditorium and theater applications.

SUMMARY OF THE INVENTION

According, it is an object of the present invention to provide a seat assembly including a frame and flexible woven supports within a molded seat cushion.

It is a further object to provide a seat assembly having a reduced thickness compared to prior art seat assemblies for additional space and ease of egress.

It is a further object of the present invention to provide a simple and cost effective method to manufacture seat assemblies of any number of sizes and designs.

These and other objectives are achieved by providing a seat assembly including an assembly frame having at least two seat connection brackets, a seat frame, two or more connectors attached to the seat frame, the two or more connectors removably attached to the two or more seat connection brackets, two or more flexible supports extending across at least a portion of the seat frame, each support including a woven material, and a foam cushion including one or more holes, wherein the seat frame and the two or more flexible supports are molded within the foam cushion, and wherein the one or more connectors extend at least partially within the one or more holes.

Further provided is a seating surface including a seat frame circumscribing an opening, two or more flexible supports fixed to the seat frame and extending across the opening, at least two connectors attached to the seat frame, the connectors adaptable to connect the seat frame to an assembly frame, and a cushion including foam molded about the seat frame and the two or more flexible supports, wherein the cushion includes at least two holes, and wherein the at least two connectors extend at least partially within the at least two holes.

In other respects, the present invention is concerned with the provision of a method for manufacturing a seat assembly including the steps of a providing an assembly frame having at least two seat connection brackets, providing a seat frame having an opening and two or more connectors attached to the seat frame, attaching two or more flexible supports to the seat frame across the opening, and cold molding a foam cushion around the seat frame and the two or more flexible supports, the cushion including two or more holes, wherein the two or more connectors extend at least partially within the two or more holes.

In some embodiments, the method includes the step of removably attaching the two or more connectors to the two or more seat connection brackets. The method may further include the steps of providing a back frame having a second opening, attaching two or more flexible back supports to the back frame across the second opening, cold molding a second foam cushion around at least a portion of the back frame and the two or more flexible back supports, and attaching the back frame to the assembly frame.

Other objects, features and advantages according to the present invention will become apparent from the following detailed description of certain advantageous embodiments when read in conjunction with the accompanying drawings in which the same components are identified by the same reference numerals.

DETAILED DESCRIPTION OF THE INVENTION

Figure 1A:
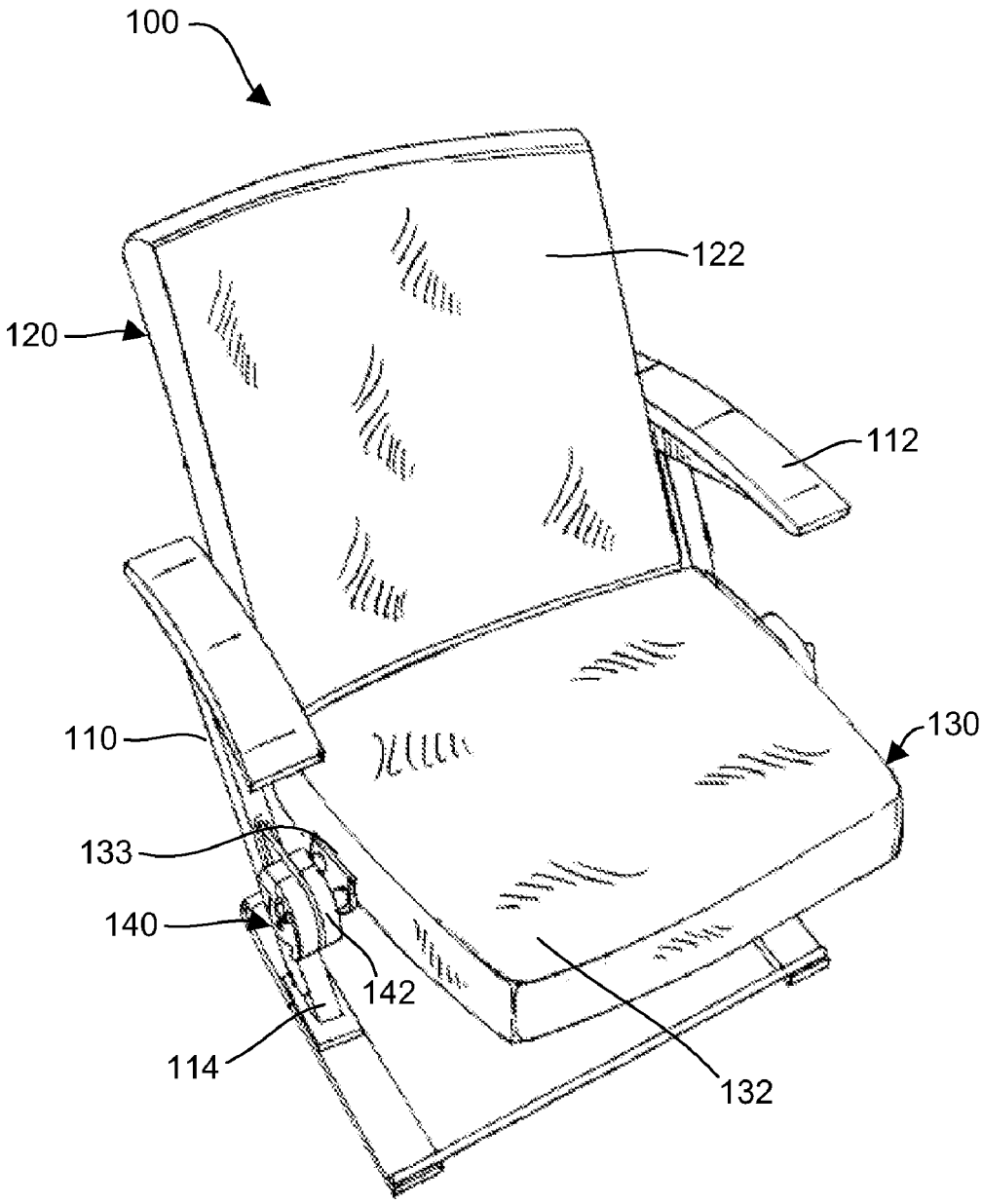
FIG. 1A is an isometric view of a seat assembly according to an exemplary embodiment of the present invention.
Figure 1B:
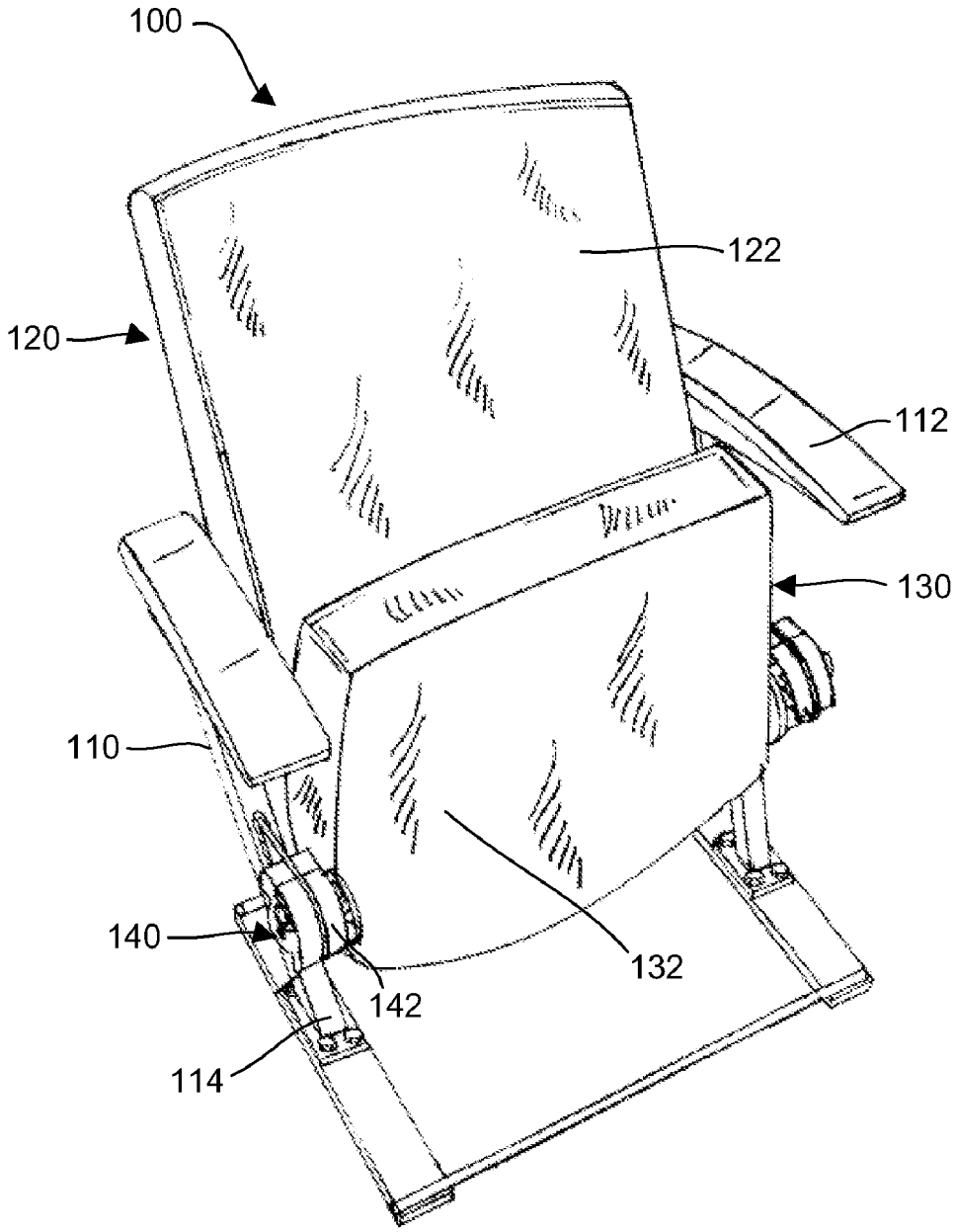
FIG. 1B is another isometric view of the seat assembly shown in FIG. 1A.

FIGS. 1A-1B show a seat assembly 100 according to an exemplary embodiment of the present invention. The seat assembly 100 includes an assembly frame 110. The assembly frame 110 may be any apparatus for supporting a seat and/or components of a seat assembly. For example, the frame 110 may comprise a horizontal beam for receiving a plurality of seats. In some embodiments, the assembly frame 110 includes arm rests 112. The assembly frame 110 may also include one or more frame supports 114. The seat assembly 100 further includes a back portion 120 and a bottom or seat portion 130 attached thereto.

The seat portion 130 is attached to the assembly frame 110 via one or more connection mechanisms 140. The connection mechanism 140 may be any means to connect one (or multiple) seat portions 130 to a frame 110. For example, the connection mechanism 140 may employ one or more brackets (e.g., 142) attached to the assembly frame 110 and one or more associated connectors attached to the seat portion 130 or a frame thereof. In some embodiments, the connection mechanism 140 is a rotatable connection. See, for example, the seat connection mechanisms disclosed in the inventor's U.S. Pat. No. 6,698,834 and U.S. Pat. No. 6,786,549, each of which is incorporated herein by reference.

Figure 2:
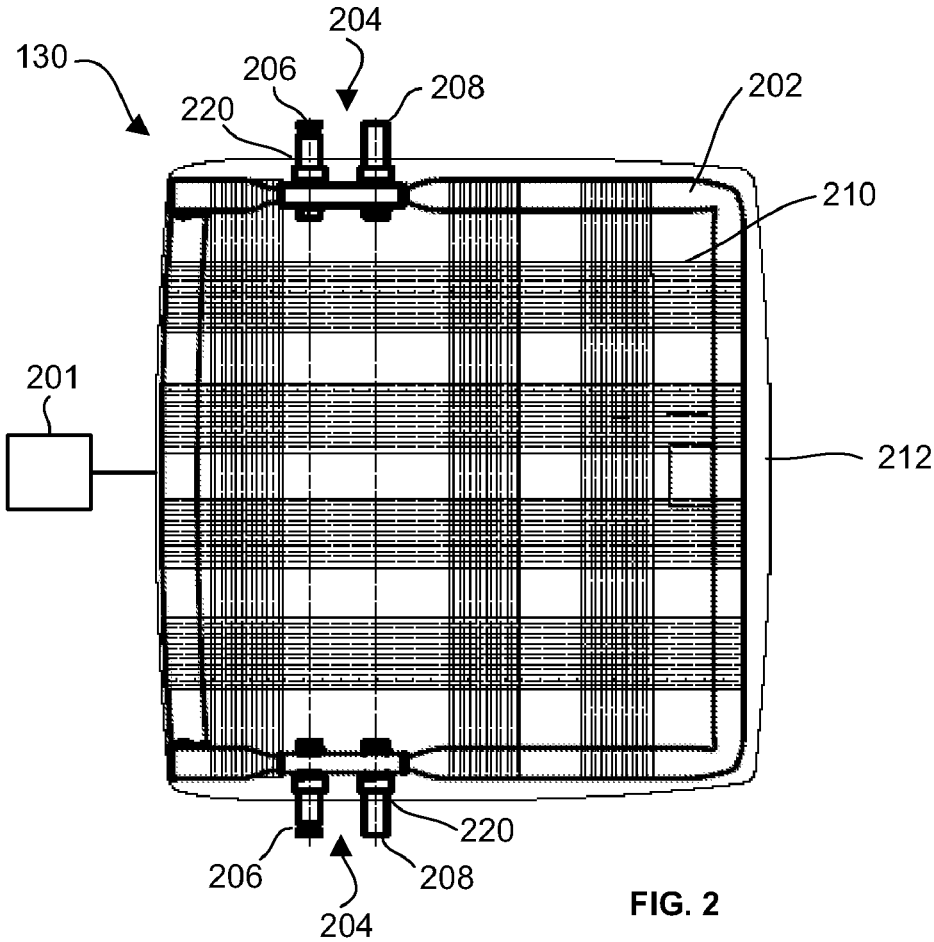
FIG. 2 is cutaway top view of a seat portion of the seat assembly shown in FIG. 1A-1B.
Figure 3:
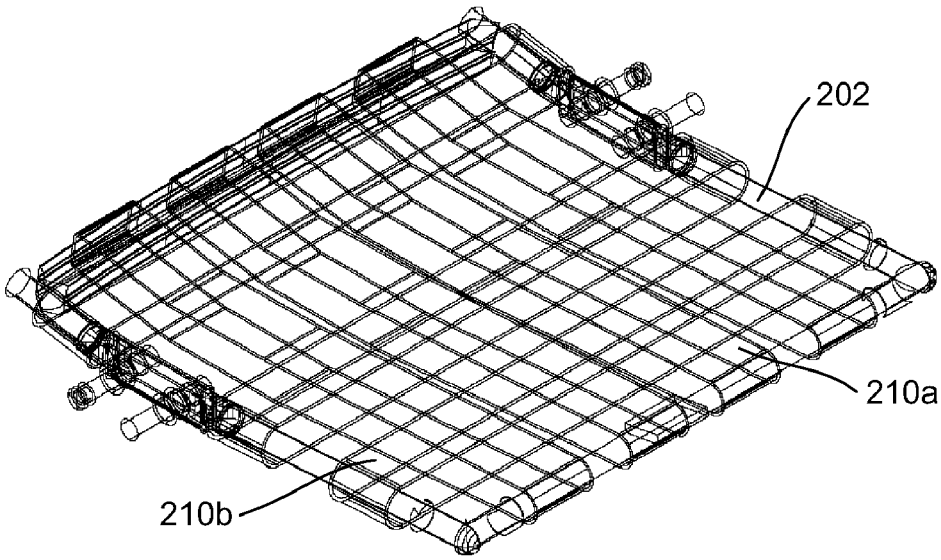
FIG. 3 is an isometric view of a frame of the seat portion shown in FIG. 2.
Figure 8:
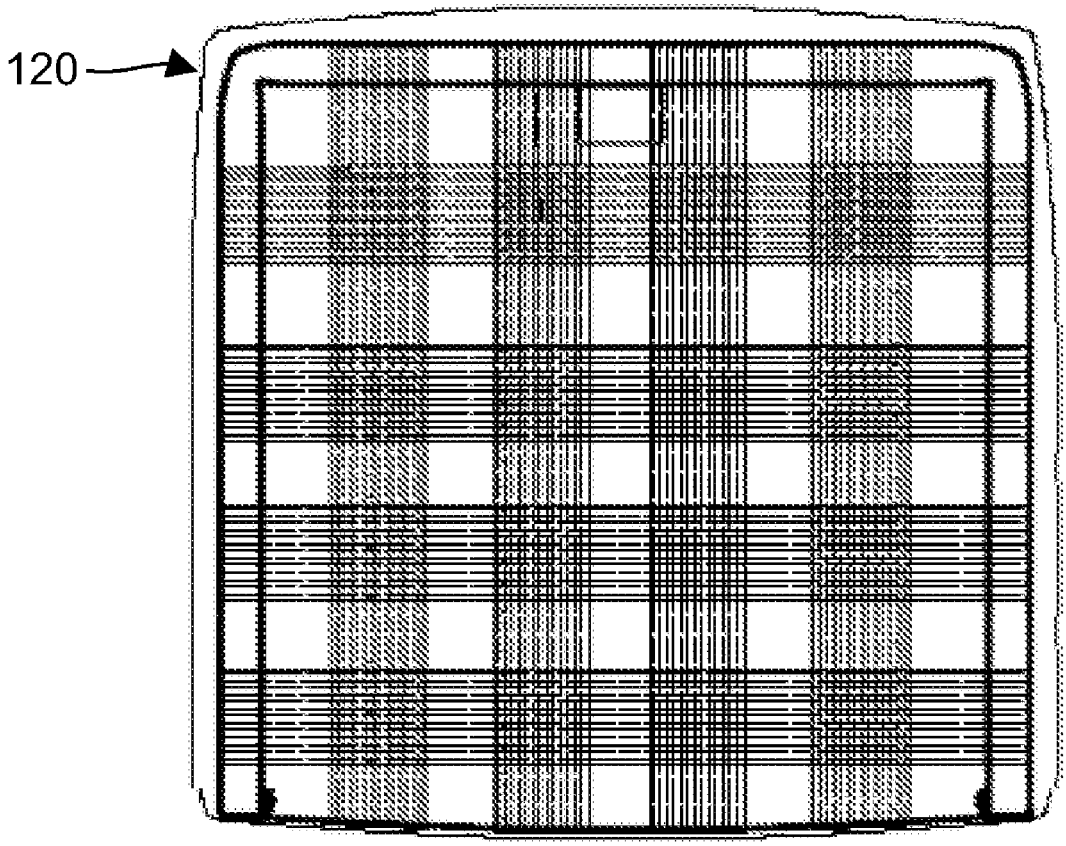
FIG. 8 is cutaway front view of a back portion of the seat assembly shown in FIGS. 1A-1B.

FIGS. 2-6 illustrate an exemplary embodiment of the seat portion 130. While detailed illustrations of the back portion 120 are not shown, it should be understood that, if desired, the back portion 120 may include similar construction (see, e.g., FIG. 8). Referring now to FIGS. 2 and 3, the seat portion 130 includes a seat frame 202. The seat frame 202 may be, for example, a tubular metal frame circumscribing a center opening. The seat frame 202 may comprise a counterweight 201 on a rear or back portion of the seat frame 202. The seat frame 202 includes seat connectors 204 attached thereto. In the exemplary embodiment, each seat connector 204 includes two pins 206/208, one of which is a pivot pin and the other a stop pin, for rotatably connecting the seat frame 202 to connection brackets 142 on the assembly frame 110. However, the connectors 204 may include any type of pins, protrusions or apparatuses for interfacing with brackets on the assembly frame 110. For example, in some embodiments, the connector 204 includes a receptacle to interface with a protruding bracket attached to the assembly frame 110.

The seat portion 130 further includes any number of flexible supports 210 extending across and/or around the seat frame 202. For example, the seat portion 130 may include supports 210*a* extending in a first direction and supports 210*b* extending in a second (e.g., crosswise) direction as shown in FIG. 3. The supports 210 are preferably woven supports comprising a fabric and/or textile material. The supports 210 preferably attach around the seat frame 202 as shown in the figures. However, the supports 210 may alternatively attach through one or more slots in the seat frame 202. The supports 210 may further be secured to the frame 202 with an adhesive, e.g., to restrict lateral movement.

Referring back to FIG. 2, the seat portion 130 further includes a foam cushion 212. The foam cushion 212 is formed around the seat frame 202 and flexible supports 210, e.g., by injecting cold molded foam. For example, the seat frame 202 and supports 210 may be placed into any desired seat mold and foam injected to form the cushion 212 around and enclosing the frame 202 and supports 210. Therefore, both the top and bottom faces of the seat portion 130 may be formed and/or shaped as desired. This feature is especially useful for rotatable seat portions 130 in which the bottom face is visible when the seat is not in use. Further, the bottom face may be shaped in manner that provides for additional space and/or egress room when the seat portion 130 is in a stored position.

Figure 4:
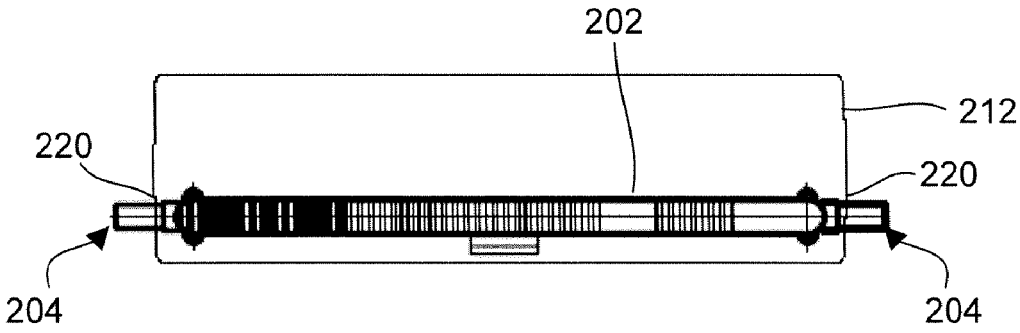
FIG. 4 is a cutaway front view of the seat portion of the seat assembly shown in FIGS. 1 A-2.
Figure 5:
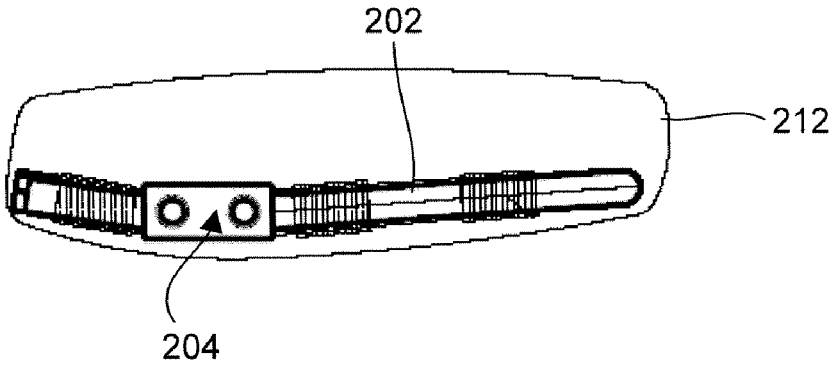
FIG. 5 is a cutaway side view of the seat portion of the seat assembly shown in FIGS. 1 A-2.
Figure 6:
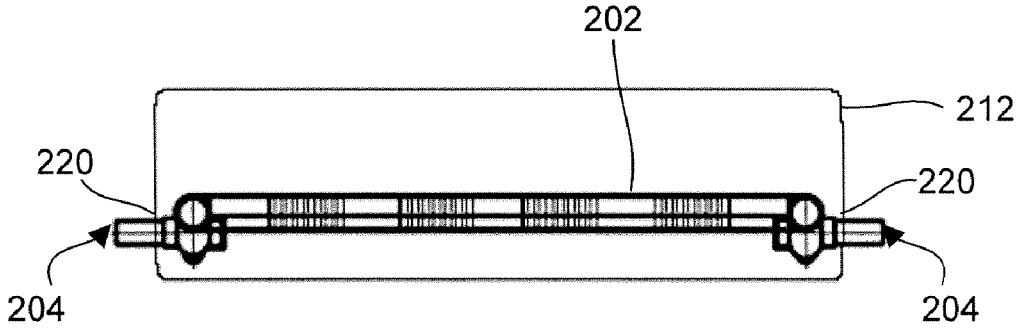
FIG. 6 is a cutaway back view of the seat portion of the seat assembly shown in FIGS. 1A-2.

As shown in FIGS. 4-6, the foam cushion 212 includes substantially all of the frame 202 and the supports 210. However, the foam cushion 212 includes one or more holes (e.g., 220) through which the connectors 204 may extend at least partially through for interfacing with the connection mechanism 140. The holes may be any shape or size to accommodate the connectors 204. In the exemplary embodiment, the cushion 212 includes two holes 220 on each side of the seat portion 130 to accommodate the pins 206/208.

Figure 7:
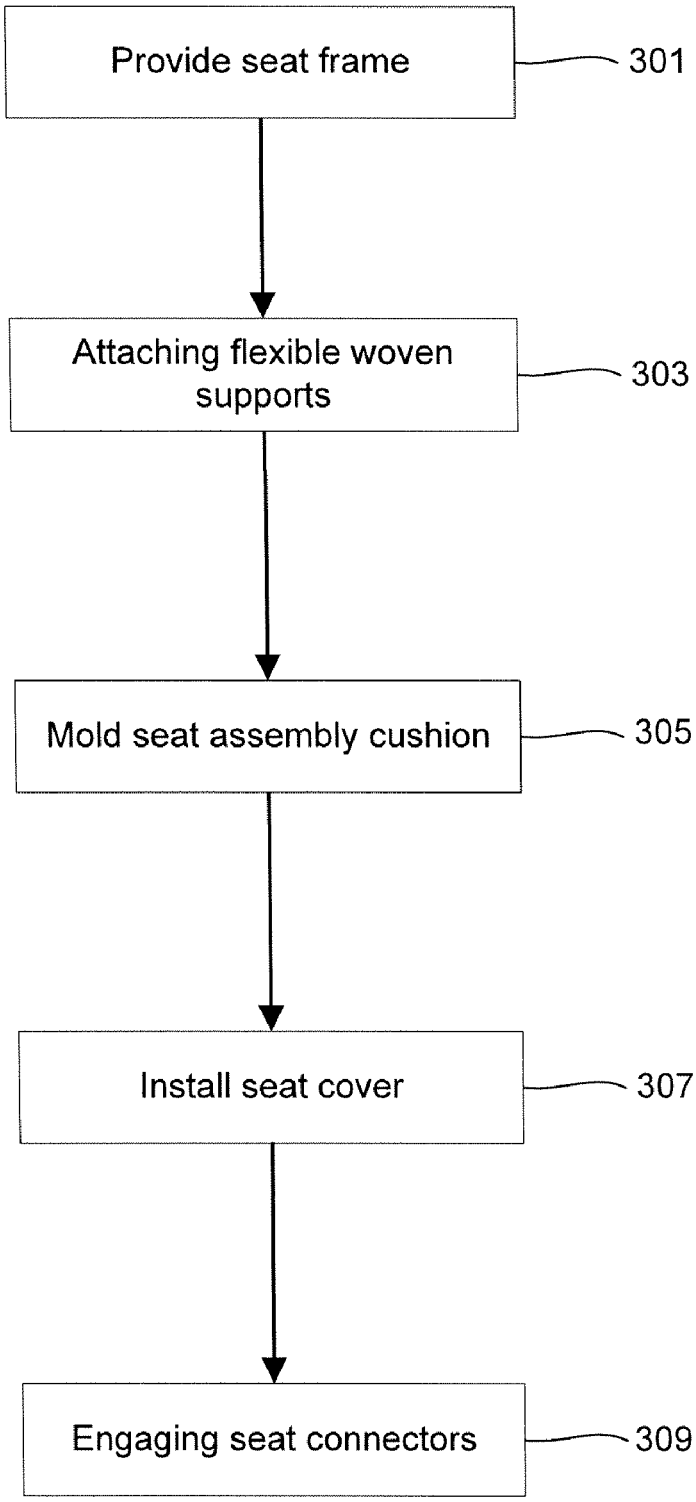
FIG. 7 illustrates a method for manufacturing the seat assembly shown in FIGS. 1A-6.

FIG. 7 illustrates a method of manufacturing a seat assembly according to the present invention. The method may include a step of providing an assembly frame (e.g., 110) having one or more seat connection brackets (not shown). Shown in FIG. 7, the method includes providing a seat frame, e.g., having an opening, and connectors attached to the seat frame (301). Two or more flexible supports are attached to the seat frame, e.g., across the opening (303). The flexible supports may be attached around the seat frame and secured with an adhesive. A cushion is then molded (e.g., via injection molding) around the seat frame and the two or more flexible supports (305). The cushion may include holes within which the connectors for interfacing with seat connection mechanisms extend.

A cover 122 and/or 132 may then be applied to the seat portion, if desired (307). For example, a seat cover 132 which encloses the seat frame, the two or more flexible supports and the foam cushion, may be used. Preferably the seat cover is fitted to the cushion and includes a zipper for ease of assembly and removal. Further, the seat cover may include two or more cover holes 133 coinciding with the two or more holes of the foam cushion. As one of ordinary skill in the art will understand, the cover may comprise any material, such as a fabric, textile, leather, etc. Covers may also be replaced and interchanged as desired.

The method further includes a step of removeably attaching or engaging the two or more connectors of the seat to connection brackets or mechanisms on the assembly frame (309). The seat may be rotateably attached to an assembly frame (i.e., for rotation from a seated position to a stored position), or attached in a fixed seated position.

The method according to the present invention may also include steps of manufacturing and installing a back portion of the seat assembly. In some embodiments, the back portion is constructed using convention methods. However, in preferred embodiments, the back portion is manufactured by providing a back frame, attaching two or more flexible back supports across the back frame (and/or an opening of the back frame), and cold molding a second foam cushion around the back frame and its supports. Depending on the connection means employed, the cushion of the back portion may encompass the entire back frame and supports, or only a portion thereof.

Advantages of the present include the provision of a seat assembly that is light weight, comfortable, and cost effective. The present invention provides a seat assembly that may be thinner than prior art assemblies while providing better strength and support. The reduced size further provides for ease of egress and a smaller required envelope for rotation of the seat bottom. The disclosed seat assembly is also substantially more durable and has a longer lifecycle than prior art seats employing springs and/or wire mesh. The enclosed interior of the seat assembly according to the present invention is also not prone to condensation, and rust, as is a problem in the prior art. The present invention also enables the manufacture of any number of seat designs using the same or similar support material and within little or no new tooling.

Although the invention has been described with reference to a particular arrangement of parts, features and the like, these are not intended to exhaust all possible arrangements or features, and indeed many modifications and variations will be ascertainable to those of skill in the art.

What is claimed is:

1. A seat assembly, comprising:

an assembly frame having at least two seat connection brackets;

a tubular metal seat frame;

two or more connectors attached to the seat frame, said two or more connectors removeably attached to the two or more seat connection brackets;

two or more flexible supports extending across at least a portion of said seat frame, each support comprising a woven material, wherein at east one of said flexible supports extends across said seat frame in a first direction, and at east one of said flexible support extends across said seat frame in a second direction crosswise to the first direction; and a foam cushion including one or more holes, wherein said foam cushion is formed by injection molding;

wherein substantially all of said seat frame and said two or more flexible supports are injection molded within said foam cushion, and wherein the one or more connectors extend at least partially within the one or more holes.

2. The seat assembly according to claim 1, further comprising:

a back frame attached to said assembly frame; and two or more flexible back supports extending across said back frame.

3. The seat assembly according to claim 2, further comprising:

a second foam cushion formed by injection molding, wherein substantially all of said back frame and said two or more flexible back supports are injection molded within said second foam cushion.

4. The seat assembly according to claim 1, wherein said seat frame circumscribes an opening, wherein each of said two or more flexible supports extend across at least a portion of the opening.

5. The seat assembly according to claim 1, wherein said two or more flexible supports are fixed around said seat frame with an adhesive.

6. The seat assembly according to claim 1, wherein said seat frame rotates between a seating position and a stored position about the at least two seat connection brackets.

7. The seat assembly according to claim 6, wherein said seat frame comprises a counterweight on a rear portion of said seat frame.

8. The seat assembly according to claim 1, further comprising:

a seat cover for enclosing said foam cushion, said seat frame and said two or more flexible supports;

wherein said seat cover comprises one or more cover holes coinciding with the one or more holes of the foam cushion.

9. The seat assembly according to claim 1, wherein said foam cushion comprises at least two molded faces including a top molded face and a bottom molded face.

10. The seat assembly according to claim 1, wherein each of the seat connection brackets comprise a pivot channel, an occupied position stop, an unoccupied position stop, and an outer surface which extends between the occupied position stop and the unoccupied position stop;

wherein each of said connectors comprise a pivot pin and a stop pin; and wherein, when the pivot pin is inserted into the pivot channel, said seat frame is pivotable from an occupied position where the stop pin abuts the occupied position stop to an unoccupied position where the stop pin abuts the unoccupied position stop.

11. A seating surface, comprising:

a tubular seat frame circumscribing an opening;

two or more flexible supports fixed to said seat frame and extending across the opening, each support comprising a woven material, wherein at least one of said flexible supports extends across the opening in a first direction, and at east one of said flexible support extends across the opening in a second direction crosswise to the first direction;

at least two connectors attached to said seat frame, said connectors adaptable to connect said seat frame to an assembly frame; and a cushion comprising foam injection molded around and enclosing substantially all of said seat frame and said two or more flexible supports, wherein said cushion includes at least two holes, and wherein said at least two connectors extend at least partially within the at least two holes.

12. The seating surface according to claim 11, wherein each of said at least two connectors comprises at least one protrusion for rotatably connecting said seat frame to a seat connection bracket.

13. The seating surface according to claim 11, wherein said seat frame rotates from a seating position to a stored position about said two or more connectors, and wherein said seat frame comprises a counterweight on a back portion of said seat frame.

14. The seating surface according to claim 11, further comprising:

a back portion for providing back support to a user of said seat surface, said back portion comprising:

a back frame circumscribing a second opening, two or more flexible supports fixed to said back frame and extending across the second opening, and a second cushion comprising injection molded foam, wherein substantially all of said back frame and said two or more flexible back supports are injection molded within said second foam cushion.

15. The seating surface according to claim 11, further comprising:

a seat cover for enclosing said cushion, said seat frame and said two or more flexible supports;

wherein said seat cover comprises one or more cover holes coinciding with the one or more holes of the foam cushion.

16. The seating surface according to claim 11, wherein each of said at least two connectors are adaptable to attach to a seat connection bracket comprising a pivot channel, an occupied position stop, an unoccupied position stop, and an outer surface which extends between the occupied position stop and the unoccupied position stop;

wherein each of the connectors comprise a pivot pin and a stop pin; and wherein, when the pivot pin is inserted into the pivot channel, the seating surface is pivotable from an occupied position where the stop pin abuts the occupied position stop to an unoccupied position where the stop pin abuts the unoccupied position stop.

17. A method of manufacturing a seat assembly, comprising the steps of:

providing an assembly frame having at least two seat connection brackets;

providing a tubular seat frame having an opening and two or more connectors attached to the seat frame;

attaching two or more flexible supports comprising a woven material to the seat frame across the opening, wherein at least one of said flexible supports extends across the opening in a first direction, and at east one of said flexible support extends across the opening in a second direction crosswise to the first direction; and cold molding a foam cushion, via injection molding, around and enclosing substantially all of the seat frame and the two or more flexible supports, the cushion including two or more holes, wherein the two or more connectors extend at least partially within the two or more holes.

18. The method according to claim 17, further comprising the step of:

removeably attaching said two or more connectors to the two or more seat connection brackets.

19. The method according to claim 17, further comprising the steps of:

providing a seat cover to enclose the seat frame, the two or more flexible supports and the foam cushion, wherein the seat cover comprises two or more cover holes coinciding with the two or more holes of the foam cushion.

20. The method according to claim 17, further comprising the steps of:

providing a back frame having a second opening;

attaching two or more flexible back supports to the back frame across the second opening;

cold molding a second foam cushion around at least a portion of the back frame and the two or more flexible back supports; and attaching the back frame to the assembly frame.

21. The method according to claim 17, wherein said step of cold molding the foam cushion includes molding at least two cushion faces, including a top cushion face and a bottom cushion face.

* * * * *